US009103183B2

(12) United States Patent
He et al.

(10) Patent No.: US 9,103,183 B2
(45) Date of Patent: Aug. 11, 2015

(54) METHOD AND APPARATUS FOR LAUNCHING MULTIPLE BALLS IN A WELL

(75) Inventors: Henry X. He, Edmonton (CA); Kwong-Onn Chan, Edmonton (CA); Gene Ambrose, Calgary (CA)

(73) Assignee: Vetco Gray Inc., Houston, TX (US)

( * ) Notice: Subject to any disclaimer, the term of this patent is extended or adjusted under 35 U.S.C. 154(b) by 944 days.

(21) Appl. No.: 13/197,500

(22) Filed: Aug. 3, 2011

(65) Prior Publication Data

US 2013/0032327 A1 Feb. 7, 2013

(51) Int. Cl.
*E21B 33/13* (2006.01)
*E21B 33/068* (2006.01)

(52) U.S. Cl.
CPC ..... *E21B 33/068* (2013.01)

(58) Field of Classification Search
CPC ..... E21B 33/068; E21B 33/05
USPC ..... 166/75.15, 97.1, 373, 70; 137/268
See application file for complete search history.

(56) References Cited

U.S. PATENT DOCUMENTS

| | | | | |
|---|---|---|---|---|
| 3,322,140 | A * | 5/1967 | Scott | 137/268 |
| 4,132,243 | A * | 1/1979 | Kuus | 137/268 |
| 6,182,752 | B1 * | 2/2001 | Smith et al. | 166/70 |
| 6,390,189 | B1 * | 5/2002 | Tienari et al. | 166/75.15 |
| 6,637,512 | B2 * | 10/2003 | Casey | 166/310 |
| 7,552,763 | B2 * | 6/2009 | Claxton | 166/75.15 |
| 7,571,773 | B1 | 8/2009 | West et al. | |
| 7,575,048 | B2 * | 8/2009 | Hovelkamp et al. | 166/75.15 |
| 7,735,548 | B2 | 6/2010 | Cherewyk | |
| 7,802,620 | B2 * | 9/2010 | Arce et al. | 166/75.15 |
| 8,256,514 | B2 * | 9/2012 | Winzer | 166/291 |
| 2005/0184083 | A1 * | 8/2005 | Diaz et al. | 221/75 |
| 2010/0288496 | A1 * | 11/2010 | Cherewyk | 166/284 |
| 2012/0152525 | A1 * | 6/2012 | McGuire et al. | 166/193 |
| 2012/0211219 | A1 * | 8/2012 | McGuire et al. | 166/75.15 |
| 2012/0234534 | A1 * | 9/2012 | Hughes et al. | 166/255.1 |
| 2013/0008666 | A1 * | 1/2013 | Cherewyk | 166/373 |

FOREIGN PATENT DOCUMENTS

| | | |
|---|---|---|
| CA | 2703426 | 11/2010 |

* cited by examiner

*Primary Examiner* — Kenneth L Thompson
*Assistant Examiner* — Michael Wills, III
(74) *Attorney, Agent, or Firm* — Bracewell & Giuliani LLP

(57) ABSTRACT

A ball launcher for dispatching balls into a wellbore that includes a manifold for selective attachment to a wellhead assembly and a magazine mounted on the manifold in which the balls are stored for distribution to the manifold. Chambers are provided in a cylinder in the magazine, so that by rotating the cylinder the chambers register with a bore in the manifold, through which the balls are delivered to the wellbore. Flowing a flushing fluid into the bore in the manifold urges the balls downward. An auxiliary line through the manifold provides a conduit for the flushing fluid into the bore.

15 Claims, 5 Drawing Sheets

74
20A
24A
34
36
26
44
52
48
65
28
22
29
32
621
30

METHOD AND APPARATUS FOR LAUNCHING MULTIPLE BALLS IN A WELL

BACKGROUND OF THE INVENTION

1. Field of the Invention

This invention relates in general to operations in oil and gas wells, and in particular to completion operations with a ball launcher for successively launching an indefinite number balls into a wellbore while mounted on a wellhead assembly.

2. Description of Related Art

Balls are sometimes launched into a wellbore promote oil and gas flow from a hydrocarbon producing wellbore. Reasons for injecting the balls including using a ball as a sealing member by having the ball land on a seat formed on an end of a tubular, where the inner diameter of the tubular is less than the outer diameter of the ball. In other applications, balls may be forced with pressure through a tubular for cleaning the tubular (similar to a pigging operation) or otherwise removing debris or obstructions within the tubular. Balls may be mixed with a treating fluid that is injected into an adjoining formation that produces oil and gas. Additional examples include landing the ball in a segment of casing to divert a flow of cement during staging operations. Balls dropped within a wellbore are also used to activate tools downhole, such as by shearing a pin or directly contacting a switch or other device for activating a tool. From time to time the ball may be used to operate as a safety valve. Typically, as the wellbore is generally at a pressure greater than ambient pressure at the surface, the balls are held for a period of time within a pressurized environment prior to being dropped into the wellbore.

BRIEF SUMMARY OF THE INVENTION

Disclosed herein are example embodiments of a ball launcher for delivering balls into a wellbore. In an example embodiment a ball launcher includes a manifold body that has an axial bore in communication with the wellbore. A magazine is included that mounts on an end of the manifold body, where a cylinder is included with the magazine. A chamber extends axially through the cylinder; thus the cylinder can be rotated to align the chamber with the axial bore and a ball in the chamber can be launched into the axial bore for delivery to the wellbore. In an example embodiment, the ball launcher includes a launch system above the magazine. The launch system has a reciprocating launch rod for pushing the ball downward in the axial bore. In an example embodiment, the ball launcher includes a collet assembly and seal on a lower end of the rod for coupling with a profile in an outer circumference of the axial bore. In an example embodiment, the ball launcher includes an auxiliary line in the manifold body having an end in fluid communication with a flushing fluid and an end in fluid communication with the axial bore. In an example embodiment, the ball launcher includes a valve in the axial bore, so that when the valve is closed a pressure barrier is formed in the axial bore across the valve. In an example embodiment, the ball launcher includes another valve in the axial bore spaced axially away from the valve, so that when the another valve is closed a pressure barrier is formed in the axial bore across the another valve. In an example embodiment, the ball launcher includes a chamber with a ball disposed therein. In an example embodiment, wherein the end of the manifold body distal from the magazine is mounted on a wellhead assembly. In an example embodiment, the ball launcher includes notches on an outer periphery of the cylinder profiled for engagement by a ratcheting actuator for rotating the cylinder.

Also disclosed herein is an example of a wellhead assembly on a wellbore. In an example embodiment, the wellhead assembly includes a production tree mounted on a wellhead housing. A main bore projects through the production tree and wellhead housing and into communication with the wellbore. A manifold body is included on the production tree, where the body has an axial bore that is open to the main bore. A ball chamber is included that is in a cylinder, where the cylinder rotates into a position with the ball chamber offset from the axial bore and also rotates into a position with the ball chamber in registration with the axial bore. In an example embodiment, the wellhead assembly includes a rod insertable into the axial bore to form a pressure seal in the axial bore. In an example embodiment, the wellhead assembly includes valves spaced axially apart in the manifold body and selectively and independently closed to each form a pressure barrier across the axial bore. In an example embodiment, the wellhead assembly includes a flush line intersecting the axial bore between the valves for providing a flushing fluid to urge a ball down into the wellbore. In an example embodiment, the wellhead assembly includes a plurality of ball chambers formed through the cylinder along a circular path and oriented substantially parallel with the axial bore. In an example embodiment, the wellhead assembly includes a ratcheting device for selectively rotating the cylinder so the ball chambers register with the axial bore.

BRIEF DESCRIPTION OF THE SEVERAL VIEWS OF THE DRAWING

Some of the features and benefits of the present invention having been stated, others will become apparent as the description proceeds when taken in conjunction with the accompanying drawings, in which.

Figure 2:
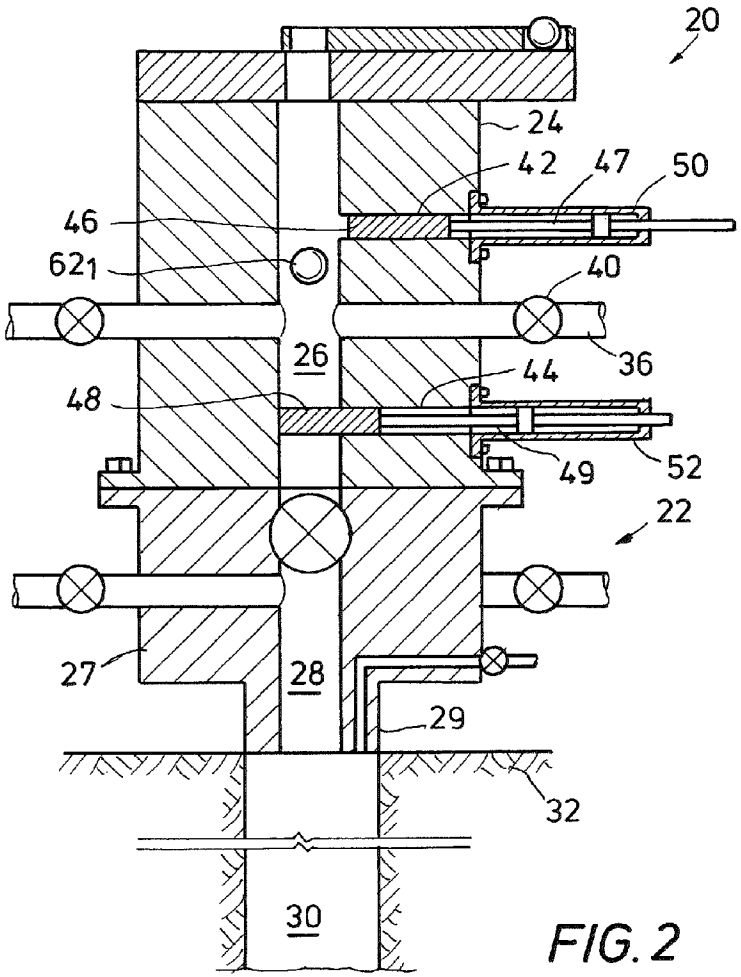
FIGS. 2 and 3 are side partial sectional views of the ball launcher of FIG. 1 in an example of use.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Figure 1:
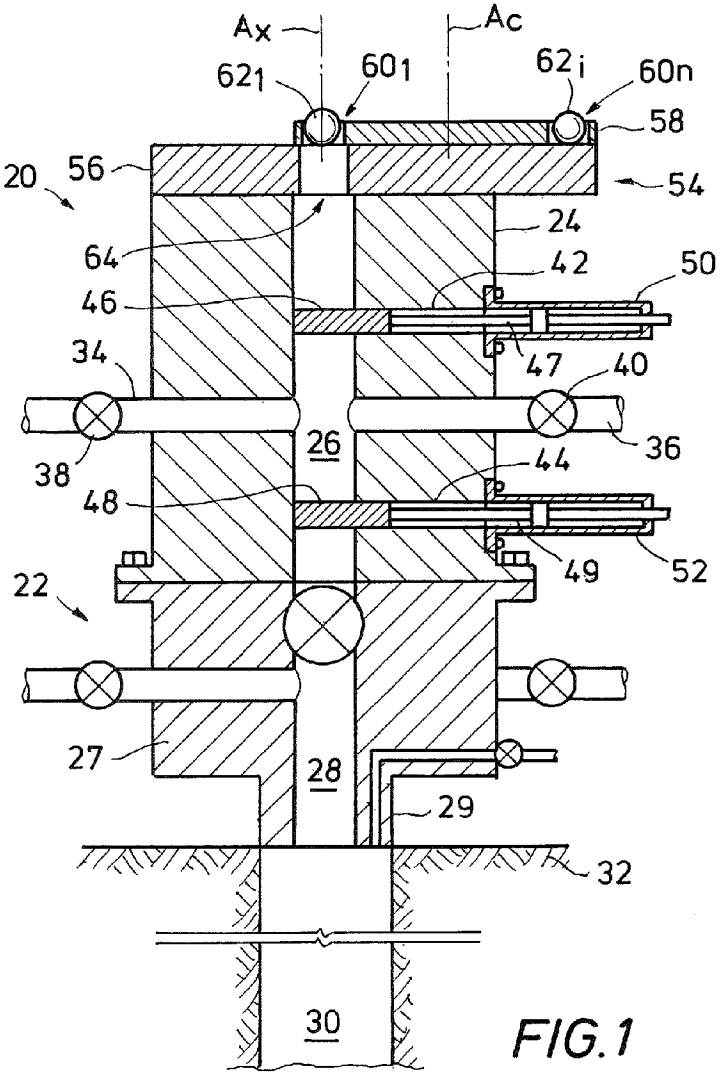
FIG. 1 is a side partial sectional view of an example embodiment of a ball launcher in accordance with the present invention.

Shown in partial side sectional view in FIG. 1, is an example embodiment of a ball launcher 20 mounted on a wellhead assembly 22. In the example of FIG. 1, the ball launcher 20 includes a manifold body 24 having an axial bore 26 formed therethrough. The upper end of the wellhead assembly 22 includes a production tree 27 on which the manifold body 24 is mounted. A main bore 28 is shown axially formed in the production tree 27 and registering with the axial bore 26 and the manifold body 24. The main bore 28 also extends downward and within a wellhead housing 29, on which the production tree 27 mounts, and into communication with a wellbore 30 that projects into a formation 32 below the wellhead assembly 22. The manifold body 24 of FIG. 1 further includes auxiliary lines 34, 36 that intersect and project radially outward from the axial bore 26. Wing valves 38, 40 are set within the auxiliary lines 34, 36 that selectively open and close to regulate flow through the auxiliary lines 34, 36. Passages 42, 44 are also shown formed laterally through the manifold body 24 that intersect with the axial bore 26. In the embodiment of FIG. 1, the passages 42, 44 are substantially parallel with auxiliary line 36 and disposed respectively above and below the auxiliary line 36. Valve assemblies are provided within the passage 42 that is made up of a gate 46 mounted on an end of a valve stem 47.

The gate 46 is shown extending within the axial bore 26 and when set in a closed position provides a pressure seal in the axial bore 26. Similarly, a gate 48 with attached valve stem 49 is set within the passage 44. The gate 48 also provides a pressure barrier within the axial bore 26 when set in its closed position. Actuators 50, 52 are provided with each of the valve assemblies for selectively reciprocating the valve gates 46, 48 and valve stems 47, 49 within the passages 42, 44 to set or remove a pressure seal within the axial bore 26.

Further illustrated in the example embodiment of FIG. 1 is a generally planar magazine assembly 54 shown set on an upper end of the manifold body 24 and opposite where the manifold body 24 mounts to the production tree 27. The magazine assembly 54 of FIG. 1 includes a planar base 56 that extends substantially over the upper end of the manifold body 24 and having a portion thereof that may optionally extend past the outer periphery of the manifold body 24. Set on the upper surface of the base 56 is a cylinder 58 whose outer radial periphery extends at least from a lateral end of the base 56 and projects past where the base 56 is intersected by an axis $A_X$ of the axial bore 26. The cylinder 58 of FIG. 1 has an axis $A_C$ that is laterally offset from and generally parallel with axis $A_X$. The cylinder 58 has a diameter exceeding its thickness/height. The cylinder 58 is provided with chambers $\mathbf{60}_1$-$\mathbf{60}_n$ (FIG. 7) that each define an open passage through the cylinder 58 and in a direction substantially parallel with the axis $A_X$. Balls $\mathbf{62}_1$-$\mathbf{62}_i$ are shown set within each of the chambers $\mathbf{60}_1$-$\mathbf{60}_i$; each ball $\mathbf{62}_1$-$\mathbf{62}_i$ may have the same or a different shape and/or diameter than any other ball $\mathbf{62}_1$-$\mathbf{62}_i$. Optionally, more than one ball $\mathbf{62}_1$-$\mathbf{62}_i$ may be provided within one or more of the chambers $\mathbf{60}_1$-$\mathbf{60}_i$. The base 56 also includes an opening 64 that is formed therethrough and in a direction generally parallel with the axis $A_X$. In the embodiment of FIG. 1, the opening 64 registers with the axial bore 26 thereby allowing access to within a portion of the axial bore 26 through the magazine assembly 54.

Figure 3:
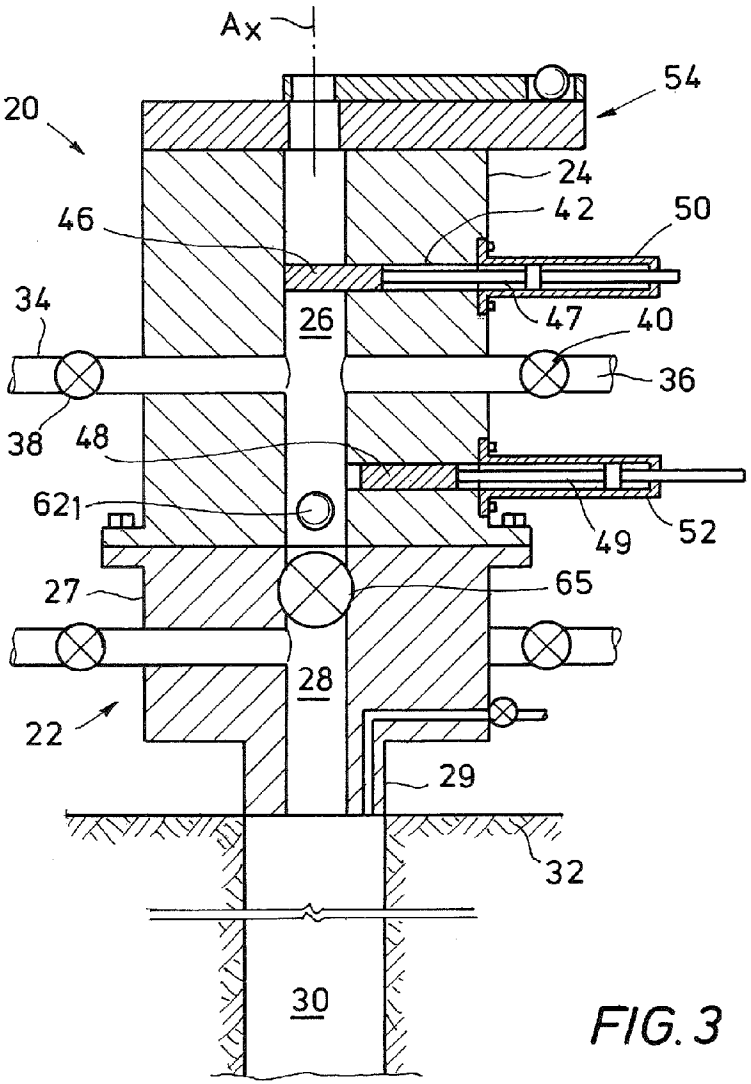

Shown in FIG. 2, the ball $\mathbf{60}_1$ within the chamber $\mathbf{62}_1$ registered with the opening 64 in FIG. 1 is shown having fallen through the opening 64 and dropping within the axial bore 26. Valve gate 46 has been retracted within the passage 42 by the actuator 50 to open the axial bore 26 and allow ball $\mathbf{62}_1$ travel downward past the passage 42 to the lower valve gate 48. Referring now to FIG. 3, valve gate 46 is reinserted into the axial bore 26 by the actuator 50 to reform the pressure seal in the axial bore 26. Conversely, valve gate 48 is shown pulled from within the axial bore 26 and out of the path of the ball $\mathbf{62}_1$ so it can continue to travel downward into the production tree 27. A swab valve 65 in the production tree 27 is selectively put into an open position so the ball $\mathbf{62}_1$ may enter the main bore 28 on its way downward into the wellbore 30 below.

Figure 4:
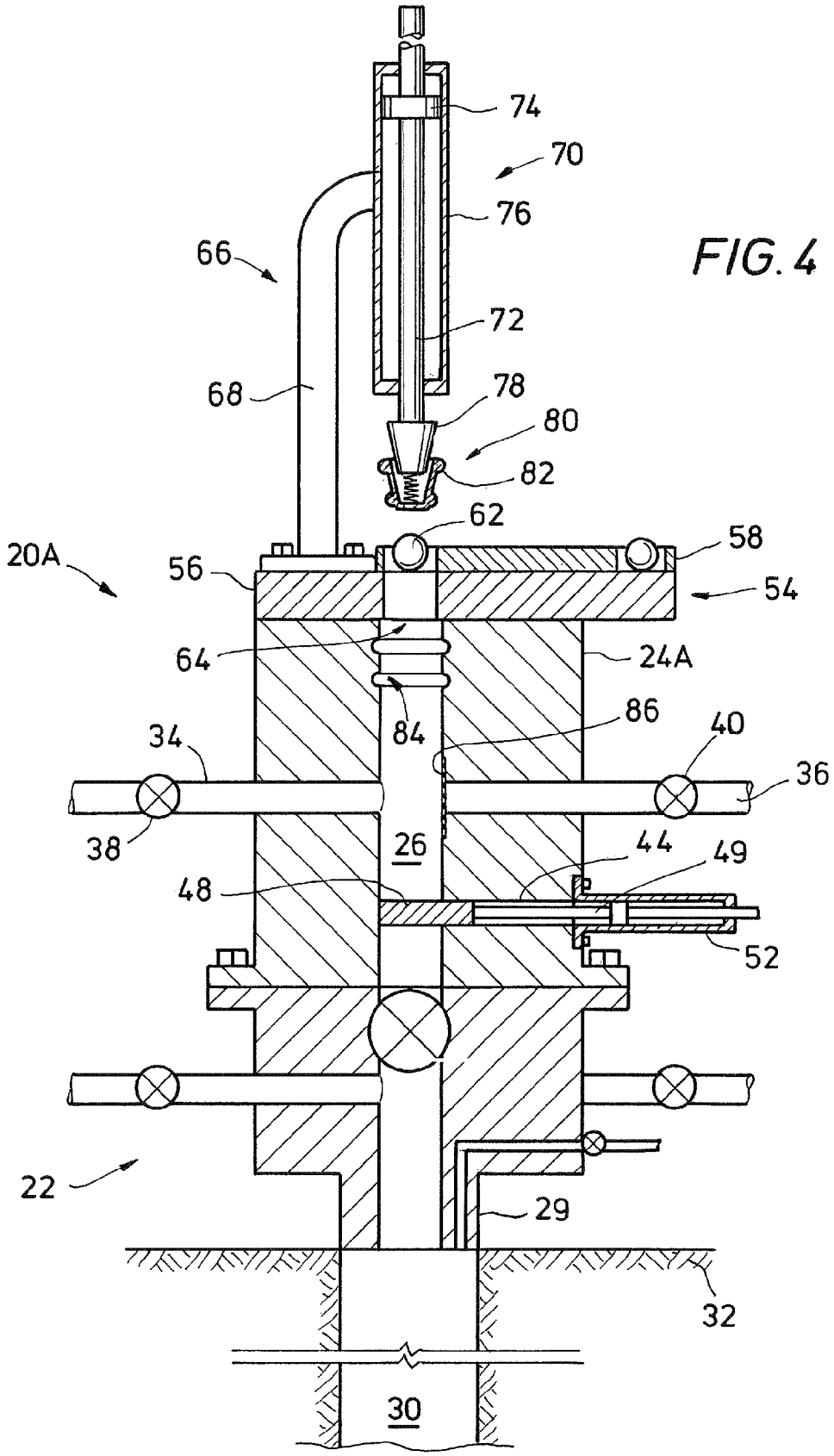
FIG. 4 is a side partial sectional view of an example embodiment of a ball launcher in accordance with the present invention.

An alternate embodiment of the ball launcher 20A is provided in a side partial sectional view in FIG. 4 in which a launch system 66 is included. In the example embodiment of FIG. 4, the launch system 66 mounts on an upper surface of the base 56 and includes an elongated support 68 having an end that bolts onto the base 56. The support 68 extends generally axially away from the magazine assembly 54 and curves up to where it attaches to a launch assembly 70; which is shown suspended above the magazine assembly 54 on the support 68. The launch assembly 70 reciprocates a launch rod 72, which is shown extending partially within the launch assembly 70. In one example embodiment, the launch assembly 70 may be hydraulically driven and include a piston 74 that attaches to the launch rod 72 and axially reciprocates within a cylindrical housing 76. The end of the launch rod 72 facing the magazine assembly 54 includes a tip 78 and locking plug 80 depending from the lower end of the tip 78. The locking plug 80 is provided with a shaped profile 82 on its outer periphery and configured for engagement with a profile 84 shown formed within the manifold body 24 along the outer circumference of the main bore 26. The embodiment of the launch assembly 20A of FIG. 4 is shown having a single valve gate 48 disposed in passage 44. Also, an optional protective screen 86 is illustrated provided in the entrance to auxiliary line 36 from the axial bore 26.

Figure 5:
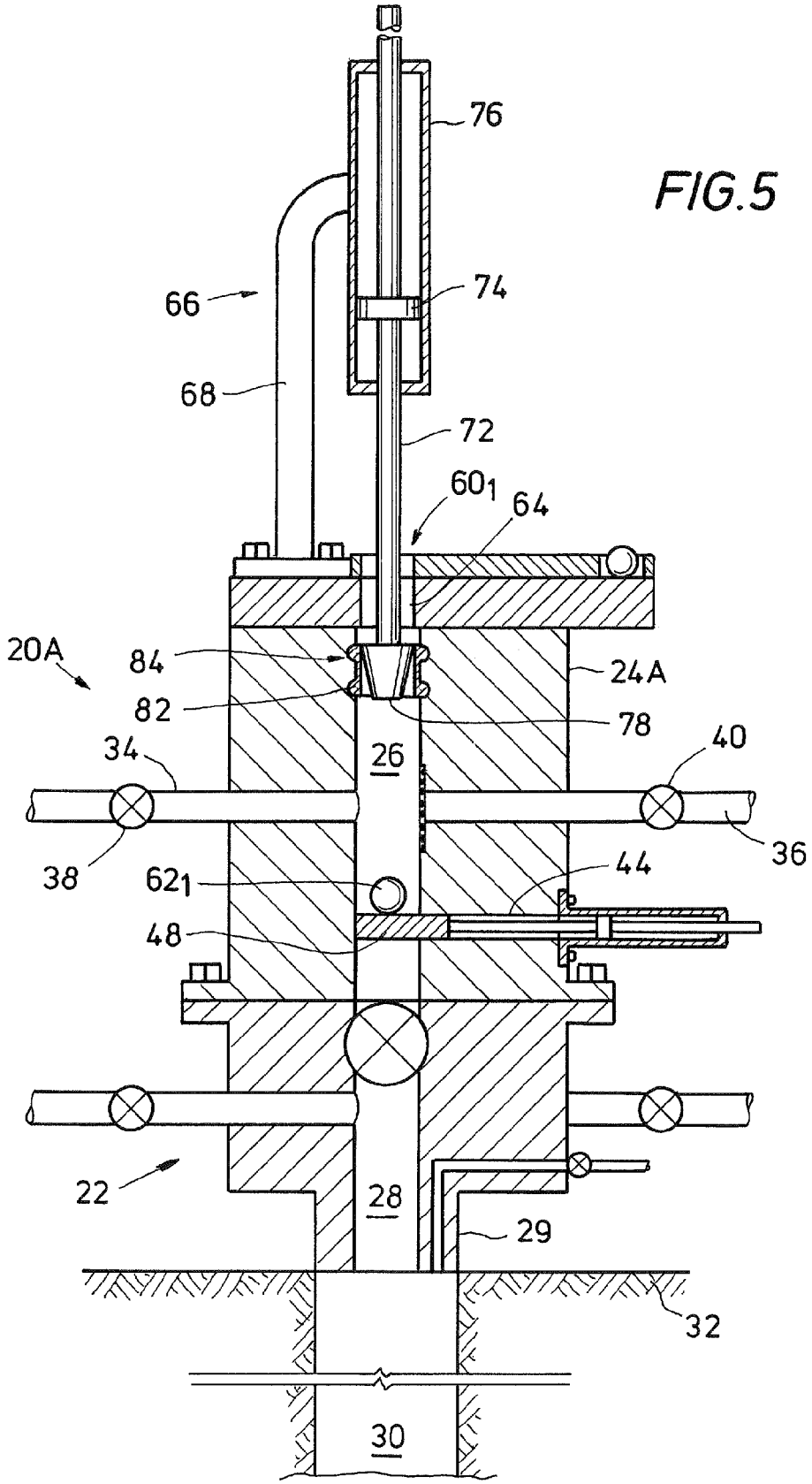
FIGS. 5 and 6 are side partial sectional views of the ball launcher of FIG. 4 in an example of use.

Referring now to FIG. 5, launcher 20A is shown in a configuration wherein the launch assembly 70 urges the launch rod 72 and launch rod tip 78 through the chamber $\mathbf{60}_1$, through the opening 64, and into the axial bore 26. Urging the launch rod 72 a designated amount into the axial bore 26 allows engagement between the profiles 82 of the launch assembly 70 and the profiles 84 in the manifold body 24. In an example embodiment, a pressure seal is formed within the axial bore 26 where the locking plug 80 with its profiles 82 engage the profiles 84. The ball $\mathbf{62}_1$ is shown within the axial bore 26 and on the valve gate 48, where either gravity or the launch rod 72 may urge the ball 62 downward into the axial bore 26 past the passage 42 and to rest on the gate 48. In environments where the wellhead assembly 22 is subjected to freezing conditions, fluids in the axial bore 26 may thicken and/or freeze to impede travel of the ball $\mathbf{62}_1$, thus the launch assembly 70 may be required to force the ball $\mathbf{62}_1$ downward past any such obstacles. As noted above, the passage 44 is set below the auxiliary lines 34, 36 and at a distance so that the upper end of the ball $\mathbf{62}_1$ remains below the auxiliary lines 34, 36.

Figure 6:
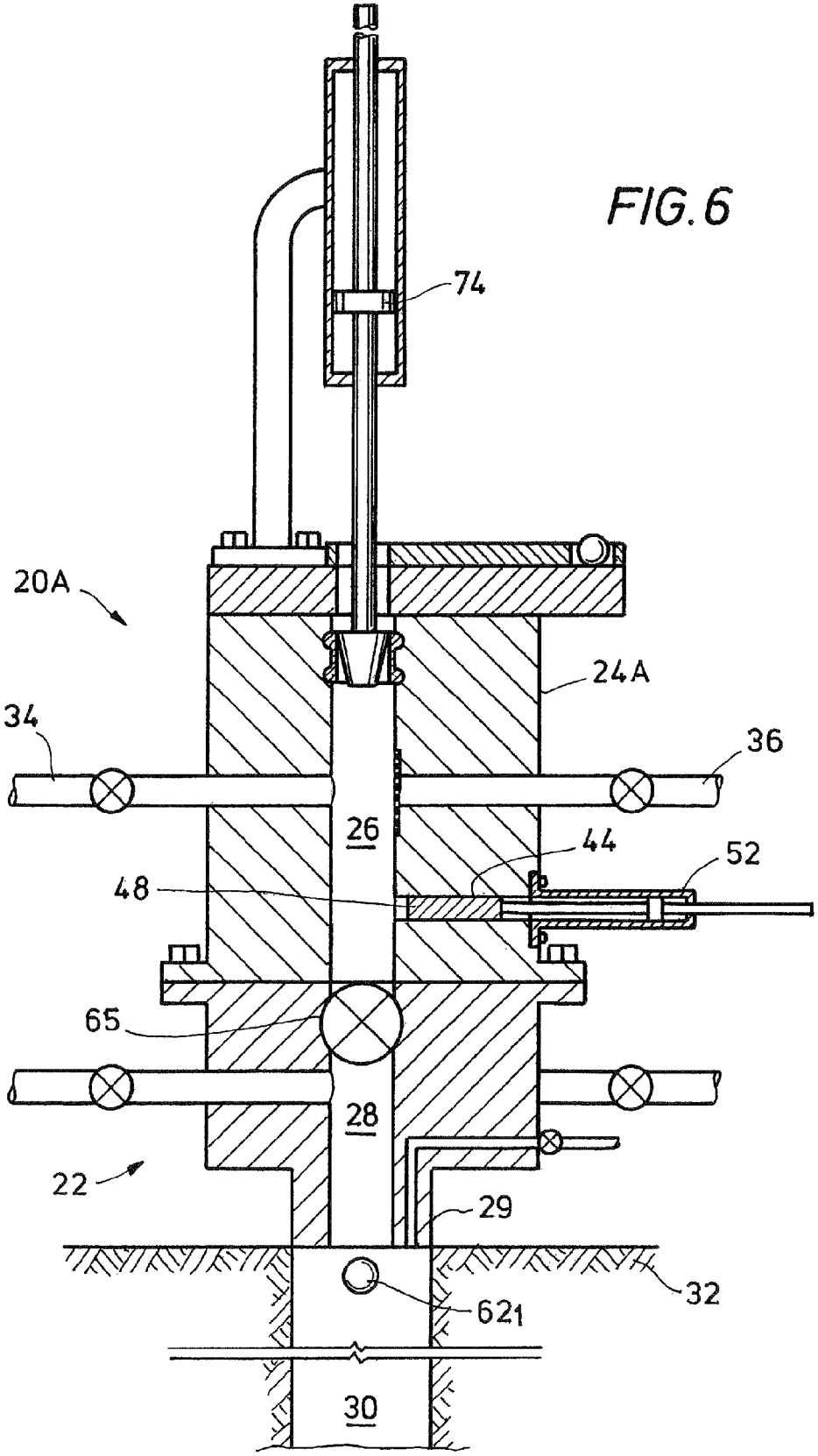

As illustrated in a partial side sectional view in FIG. 6, the gate 48 is drawn into the passage 44 from the axial bore 26 thereby opening the axial bore 26 to communication in the space from the auxiliary lines 34, 36 into the main bore 28 of the production tree 27. As the engagement of the locking plug 80 with the axial bore 26 forms a pressure seal isolating the axial bore 26 from ambient, a flushing fluid may be introduced through one or both of the auxiliary lines 34, 36 and into the axial bore 26 below the profiles 84. The flow of the fluid, coupled with pressure in the fluid, can be used for urging the ball $\mathbf{62}_1$ downward past the lower end of the axial bore 26, through swab valve 65, and into the wellbore 30.

Figure 7:
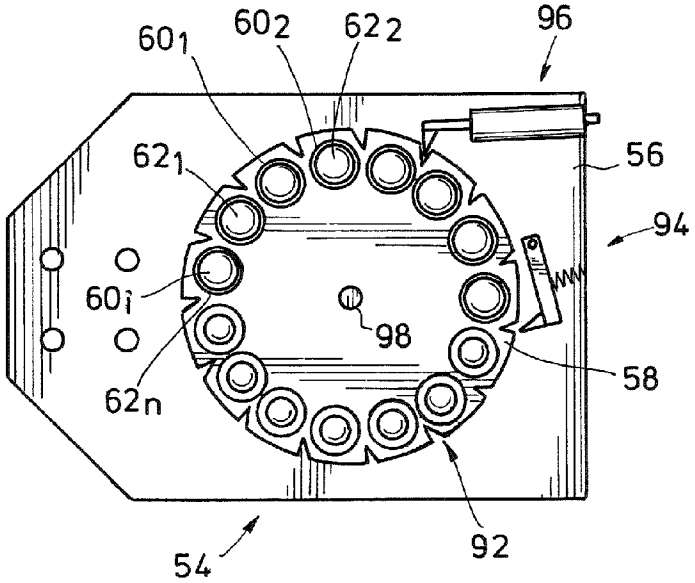
FIG. 7 is a plan view of a magazine portion of a ball launcher in accordance with the present invention.

A plan view of the magazine assembly 54 is provided in FIG. 7. In this example it can be seen that the cylinder 58 is provided with a plurality of chambers $\mathbf{60}_{1\text{-}n}$ shown formed in a generally circular path along the outer periphery of the cylinder 58. In the example of FIG. 7, each of the chambers $\mathbf{60}_{1\text{-}n}$ is provided with a corresponding ball $\mathbf{62}_{1\text{-}n}$. Embodiments exist wherein one more chambers $\mathbf{60}_{1\text{-}n}$ may be empty, or include more than one ball. Further provided in the example embodiment of FIG. 7 are notches 92 provided on the outer periphery of the cylinder 58. In the example embodiment of FIG. 7, the notches 92 have a generally triangular shaped outline and extend the entire height or thickness of the cylinder 58. Alternate embodiments exist wherein the notches 92 have rectangular, and/or curved shapes, and may extend along only a portion of the thickness of the cylinder 58. Optionally, profiled surfaces, such as depressions along an upper or lower surface may be provided on the cylinder 58 in lieu of the notches 92.

Also shown set on the upper surface of the base 56 is a spring loaded pawl 94 having a tip profiled to engage the notches 92 and to limit rotation of the cylinder 58 to a single direction, i.e. clockwise or counterclockwise. Rotating the cylinder 58 can be accomplished by a ratcheting actuator 96, also shown set on the base 56 and having an arm that reciprocates away from its body with a profile tip to engage the notches 92 thereby rotating the cylinder 58. A spindle 98 may be included that is shown at approximately the center of the cylinder 58 that can extend into the base 56 thereby allowing rotation of the cylinder 58 with respect to the base 56.

In an example of operation of the ball launcher 20, a ball $\mathbf{62}_1$ or balls $\mathbf{62}_{1\text{-}n}$ may be set within a chamber $\mathbf{60}_1$ or chambers $\mathbf{60}_{1\text{-}n}$ and the cylinder 58 rotated by the actuator 96 so that a designated chamber $\mathbf{60}_1$ may be aligned with the opening 64 of the magazine assembly 54 so the ball $\mathbf{62}_1$ drops into the axial bore 26. Moving the valve gates 46, 48, in conjunction with a flushing fluid provided through the auxiliary lines 34, 36, moves the ball $\mathbf{62}_1$ into the wellbore 30. Optionally, one of the auxiliary lines 34, 36 can be used to vent pressure from the axial bore 26 to allow the ball $\mathbf{62}_1$ to drop from the chamber $\mathbf{60}_1$ into the axial bore 26. The actuator 96 may be reactivated to rotate the cylinder 58 thereby aligning another chamber 60 with the opening 64 and repeating the process for delivering additional balls 62 into the wellbore 30. One or both of the auxiliary lines 34, 36 may be used as a blow down line to relieve pressure trapped in the axial bore between the valve gates 46, 48. Thus prior to reopening valve gate 46 one or both of the wing valves 38, 40 can be opening to vent pressure in the axial bore 26.

An example use of the embodiment of FIGS. 4-6, the ball $\mathbf{62}_1$ within the aligned chamber $\mathbf{60}_1$ may be urged into the axial bore 26 using the launch assembly 70. After the launch rod 72 is drawn out of the axial bore 26 by the launch assembly 70 the magazine assembly 54 may be rotated as described above for alignment of another chamber $\mathbf{60}_i$ for delivery of another ball $\mathbf{62}_k$.

An advantage of the device described herein is that an indefinite number of balls 62 can be delivered into the wellbore 30 merely by placing a ball 62 within any chamber 60. It should be pointed out that continuous operation can occur without the need for removing the magazine assembly 54 from the rest of the ball launcher 20.

While the invention has been shown or described in only some of its forms, it should be apparent to those skilled in the art that it is not so limited, but is susceptible to various changes without departing from the scope of the invention.

What is claimed is:

1. A ball launcher for delivering balls into a wellbore comprising:

a manifold body having an axial bore in communication with the wellbore;

a generally planar magazine mounted on an end of the manifold body having a cylinder that rotates with respect to the manifold body;

a chamber formed axially through the cylinder, so that when a ball is contained in the chamber and the cylinder is rotated, the chamber selectively registers with the axial bore in the manifold body and releases the ball into the axial bore; and a launch system projecting above the magazine having a reciprocating launch rod disposed substantially coaxial with the axial bore, so that when the chamber registers with the axial bore and the rod reciprocates through the axial bore, the ball is urged downward in the axial bore by the rod.

2. The ball launcher of claim 1, further comprising a locking plug on a lower end of the rod that selectively mates with a profile in an outer circumference of the axial bore.

3. The ball launcher of claim 1, further comprising a valve in the axial bore, so that when the valve is closed a pressure barrier is formed in the axial bore across the valve.

4. The ball launcher of claim 3, further comprising another valve in the axial bore spaced axially away from the valve, so that when the another valve is closed a pressure barrier is formed in the axial bore across the another valve.

5. The ball launcher of claim 1, further comprising multiple chambers, each chamber having a ball disposed therein.

6. The ball launcher of claim 1, wherein the end of the manifold body is distal from the magazine is mounted on a wellhead assembly.

7. The ball launcher of claim 1, further comprising notches on an outer periphery of the cylinder profiled for engagement by a ratcheting actuator for rotating the cylinder.

8. The ball launcher of claim 1, wherein an axis of the cylinder is offset from and substantially parallel with an axis of the axial bore in the manifold body.

9. A wellhead assembly on a wellbore comprising:

a production tree mounted on a wellhead housing with a main bore extending axially through the production tree and wellhead housing and into communication with the wellbore;

a manifold body on the production tree;

an axial bore in the manifold body having an end in communication with the main bore;

valves spaced axially apart in the manifold body and selectively and independently closed to each form a pressure barrier across the axial bore;

a ball chamber that is substantially parallel with the axial bore and formed in a planar cylinder that is rotatable into a position with the ball chamber offset from the axial bore and into a position with the ball chamber in registration with the axial bore.

10. The wellhead assembly of claim 9, further comprising a rod insertable into the axial bore to form a pressure seal in the axial bore.

11. The wellhead assembly of claim 9, further comprising a flush line intersecting the axial bore between the valves for providing a flushing fluid to urge a ball down into the wellbore.

12. The wellhead assembly of claim 9, further comprising a plurality of ball chambers formed through the cylinder along a circular path and oriented substantially parallel with the axial bore.

13. The wellhead assembly of claim 12, further comprising a ratcheting device for selectively rotating the cylinder so the ball chambers register with the axial bore.

14. The wellhead assembly of claim 9, wherein an axis of the cylinder is offset from and substantially parallel with an axis of the main bore.

15. A ball launcher for delivering balls into a wellbore comprising:

a manifold body having an axial bore in communication with the wellbore;

a generally planar magazine mounted on an end of the manifold body having a cylinder that rotates with respect to the manifold body;

a chamber formed axially through the cylinder, so that when a ball is contained in the chamber and the cylinder is rotated, the chamber selectively registers with the axial bore in the manifold body and releases the ball into the axial bore; and an auxiliary line in the manifold body having an end in fluid communication with a flushing fluid and an end in fluid communication with the axial bore.

* * * * *